US010143886B2

(12) United States Patent
Carpinelli et al.

(10) Patent No.: US 10,143,886 B2
(45) Date of Patent: Dec. 4, 2018

(54) GRIP EXERCISER WITH INTERCHANGEABLE RESISTANCE ELEMENTS

(71) Applicant: Implus Footcare, LLC, Durham, NC (US)

(72) Inventors: John Angelo Carpinelli, Cary, NC (US); Elliott Michael Layus, Carmichael, CA (US)

(73) Assignee: Implus Footcare, LLC, Durham, NC (US)

( * ) Notice: Subject to any disclaimer, the term of this patent is extended or adjusted under 35 U.S.C. 154(b) by 14 days.

(21) Appl. No.: 15/293,194

(22) Filed: Oct. 13, 2016

(65) Prior Publication Data

US 2018/0104539 A1 Apr. 19, 2018

(51) Int. Cl.
*A63B 23/16* (2006.01)
*A63B 21/045* (2006.01)

(52) U.S. Cl.
CPC ..... *A63B 23/16* (2013.01); *A63B 21/045* (2013.01)

(58) Field of Classification Search
CPC ..... A63B 23/16; A63B 21/045; B23D 71/00; B23D 71/02; Y10T 407/18; Y10T 407/1825
USPC ..... 482/44–50; 104/13; 220/753
See application file for complete search history.

(56) References Cited

U.S. PATENT DOCUMENTS 1,026,215 A * 5/1912 Korth ..... A63B 21/023 482/50
2,475,608 A * 7/1949 Gasparich ..... B25G 1/00 279/102
2,737,704 A * 3/1956 Cinocca ..... B25G 1/00 279/76
2,804,732 A * 9/1957 Brockley ..... B24D 15/08 403/334
2,809,846 A * 10/1957 Whiteford ..... B25G 1/00 279/102
3,510,130 A * 5/1970 Ferdinand ..... A63B 21/00043 482/127
3,807,729 A * 4/1974 Sigma ..... A63B 21/0455 235/121
4,197,611 A * 4/1980 Bell ..... A47J 45/08 16/DIG. 12
4,433,364 A * 2/1984 Noble ..... A63B 21/00043 200/60
4,555,111 A * 11/1985 Alvarez ..... A63B 69/0002 473/457

(Continued)

*Primary Examiner* — Andrew S Lo
(74) *Attorney, Agent, or Firm* — Edward S. Wright

(57) ABSTRACT

Exerciser for strengthening the grip of the hand and/or muscles of the forearm having a pair of handgrips or handles which are removably mounted on the arms of a helical torsion spring in a manner permitting the grips to be used interchangeably with springs having different strengths or resistances. The handgrips are fabricated at least in part of rubber or other rubberized material with longitudinally extending bores having resilient side walls configured for frictional engagement with spring arms of different diameters in a manner that permits rotational slippage of the handgrips about the spring arms and limits axial movement of the handgrips on the spring arms when the grip exerciser is in use and permits the handgrips to slide axially along the spring arms during installation and removal of the handgrips.

28 Claims, 8 Drawing Sheets

(56) References Cited

U.S. PATENT DOCUMENTS

| | | | | | |
|---|---|---|---|---|---|
| 4,558,864 | A * | 12/1985 | Medwedeff | A63B 21/0455 | 273/148 B |
| 4,623,141 | A * | 11/1986 | Salvino | A63B 21/0455 | 482/127 |
| 4,646,405 | A * | 3/1987 | Reinhold | B25G 3/10 | 30/329 |
| 4,756,522 | A * | 7/1988 | Sandoval | A63B 21/0004 | 482/126 |
| 4,763,896 | A * | 8/1988 | Press | A63B 23/16 | 482/122 |
| 4,943,047 | A * | 7/1990 | Noble | A61B 5/225 | 340/321 |
| 5,060,934 | A * | 10/1991 | Winston | A63B 21/0004 | 482/126 |
| 5,762,344 | A * | 6/1998 | Einvall | B23D 71/04 | 279/96 |
| 5,788,617 | A * | 8/1998 | Paris | A63B 21/00043 | 482/112 |
| 5,896,621 | A * | 4/1999 | Lindgren | B25G 3/10 | 16/114.1 |
| 6,109,619 | A * | 8/2000 | Fine | B23B 31/008 | 279/83 |
| 9,415,262 | B2 * | 8/2016 | An | A63B 23/16 | |
| 9,821,449 | B2 * | 11/2017 | Chen | B25G 3/24 | |
| 2010/0162528 | A1 * | 7/2010 | Chen | B25G 1/10 | 16/422 |
| 2015/0290491 | A1 * | 10/2015 | An | A63B 23/16 | 482/49 |
| 2016/0067539 | A1 * | 3/2016 | Carpinelli | A63B 23/16 | 482/49 |

* cited by examiner

Fig. 2
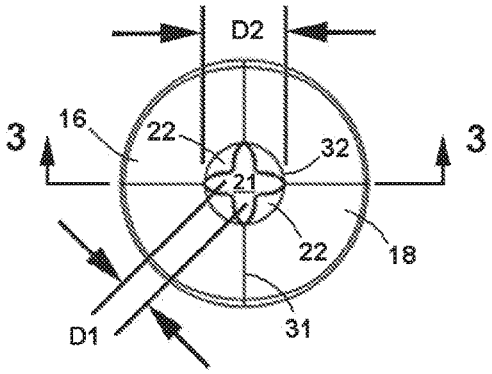
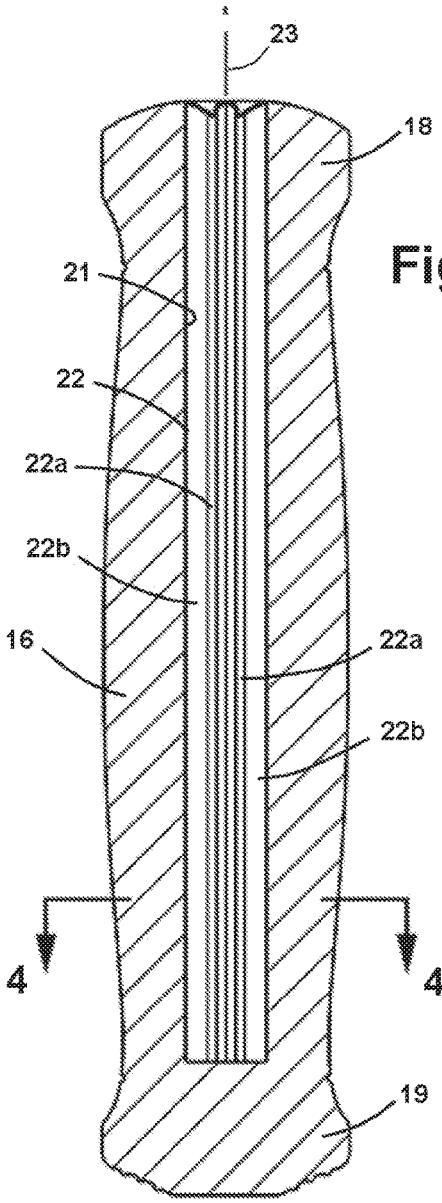
Fig. 3
Fig. 4
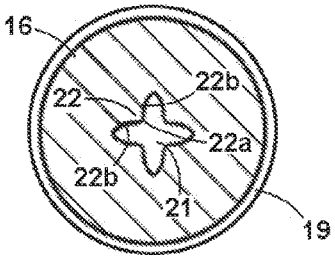
Fig. 5
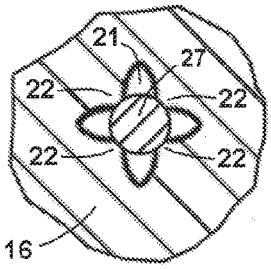
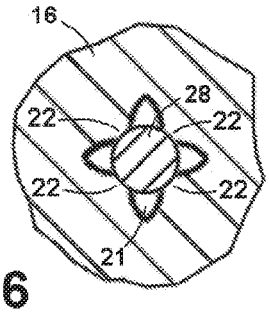
Fig. 6
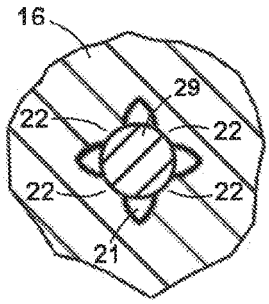
Fig. 7

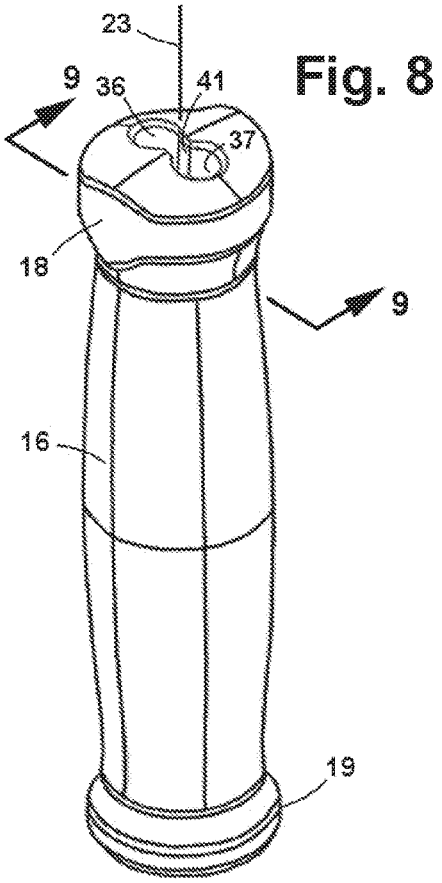
Fig. 8
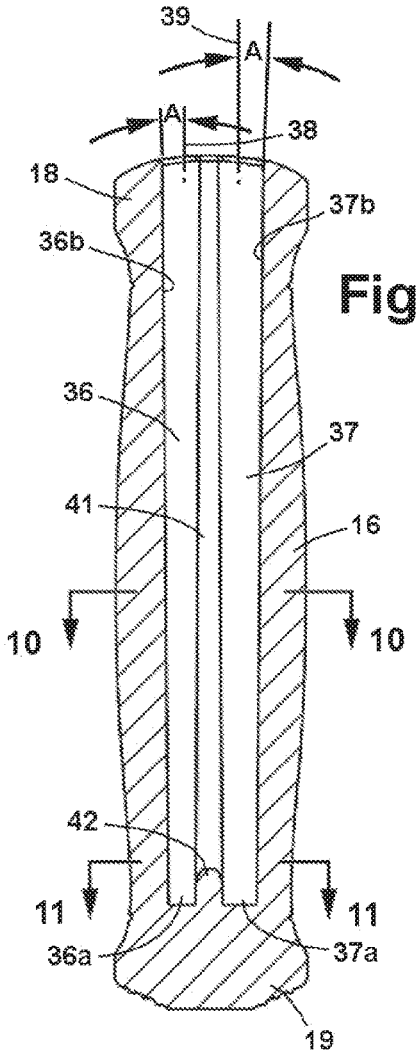
Fig. 9
Fig. 10
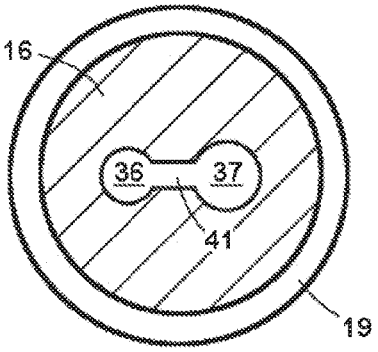
Fig. 11
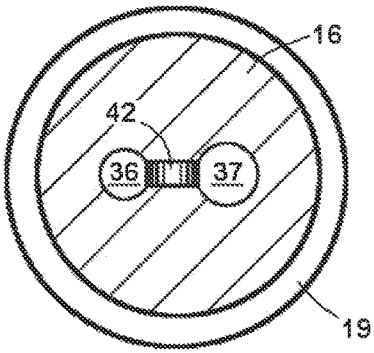

Fig. 23
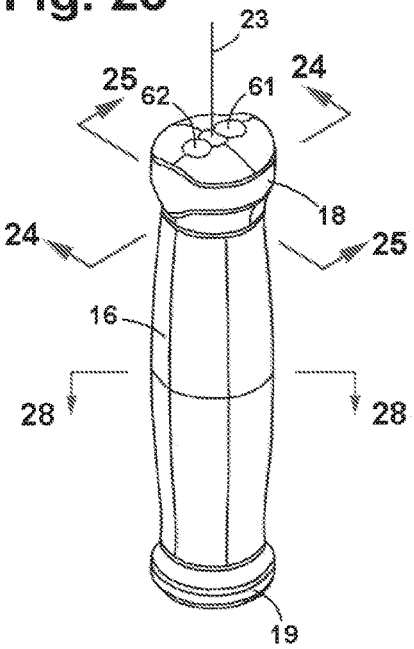
Fig. 24
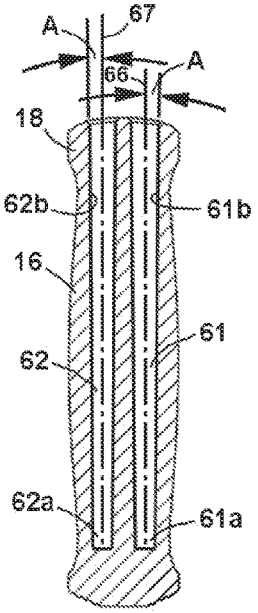
Fig. 25
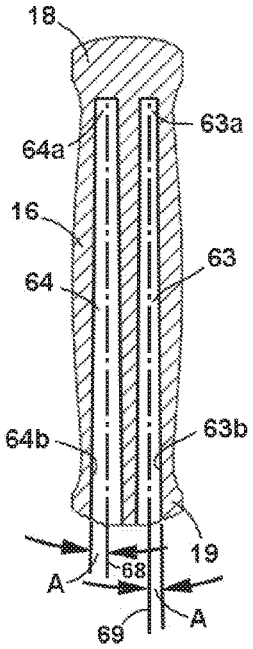
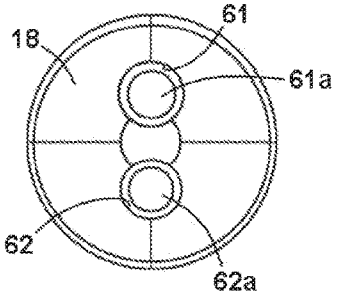
Fig. 26
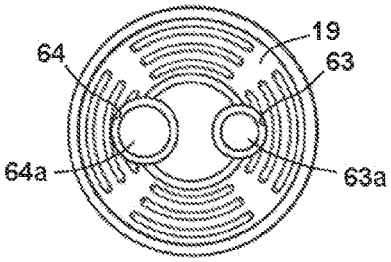
Fig. 27
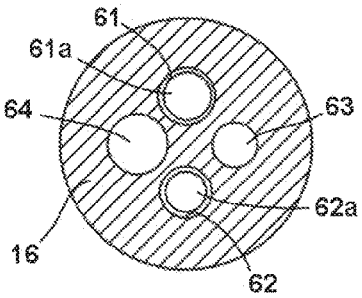
Fig. 28

Fig. 33
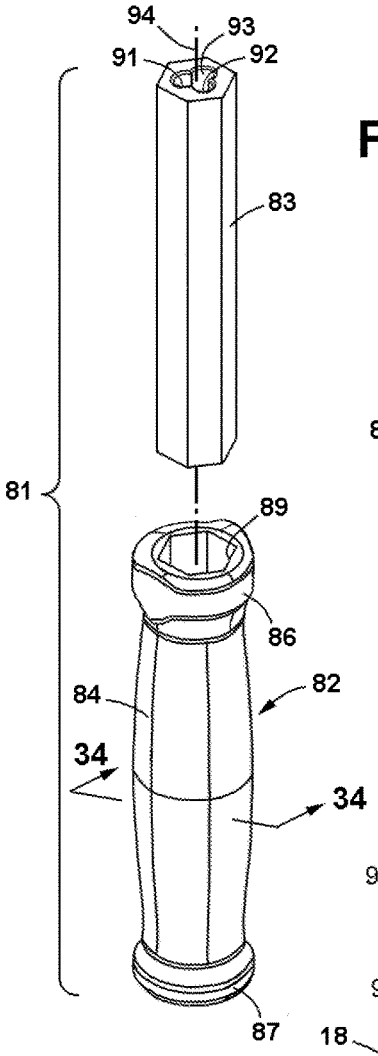
Fig. 34
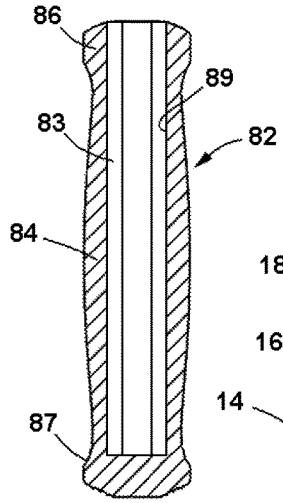
Fig. 35
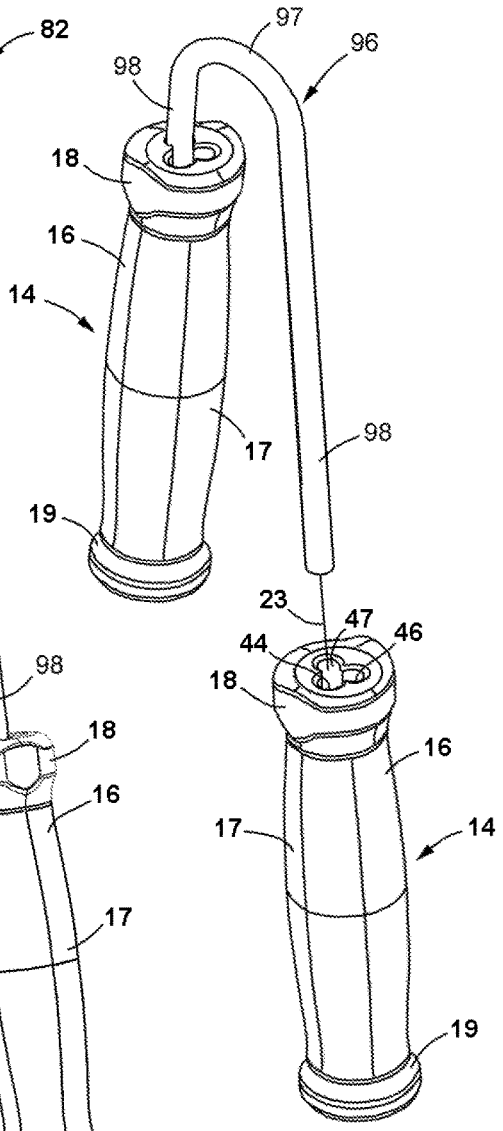
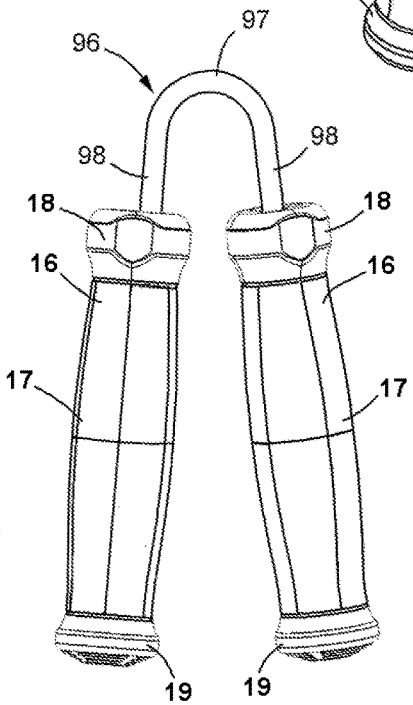
Fig. 36

GRIP EXERCISER WITH INTERCHANGEABLE RESISTANCE ELEMENTS

BACKGROUND OF THE INVENTION

Field of Invention

This invention pertains generally to exercise and fitness equipment and, more particularly, to an exerciser with interchangeable resistance elements for strengthening the grip of the hand and/or muscles of the forearm.

Related Art

Grip exercisers with handles or grips on the diverging arms of a helically coiled torsion spring are widely used in exercising and strengthening the muscles of the hand. Such devices are available in different sizes and resistances, and two examples of such devices are found in U.S. Pat. Nos. 5,060,934 and 5,308,299. Another patent (U.S. Pat. No. 1,026,215) shows a combined grip exerciser and dumbbell in which a dumbbell is mounted on one arm of the spring, and a grip is mounted on the other.

OBJECTS AND SUMMARY OF THE INVENTION

It is, in general, an object of the invention to provide a new and improved grip exerciser for strengthening the muscles of the hand and/or muscles of the forearm.

Another object is to provide a grip exerciser of the above character which overcomes the limitations and disadvantages of grip exercisers heretofore provided.

These and other objects are achieved in accordance with the invention by providing an exerciser for strengthening the grip of the hand and/or muscles of the forearm which comprises a plurality of springs of different sizes and resistances each having a pair of arms which can be squeezed together against the resistance of the spring, a pair of handgrips or handles which are mounted on the arms of one of the springs and adapted to be interchangeably mounted on the arms of the other springs. The handgrips are fabricated at least in part of rubber or other rubberized material with longitudinally extending bores having resilient side walls configured for frictional engagement with spring arms of different diameters in a manner that permits rotational slippage of the handgrips about the spring arms and limits axial movement of the handgrips on the spring arms when the grip exerciser is in use and permits the handgrips to slide axially along the spring arms during installation and removal of the handgrips.

BRIEF DESCRIPTION OF THE DRAWINGS

FIG. 2 is a top plan view of one of the handgrips in the embodiment of FIG. 1.

FIG. 3 is a vertical sectional view of one of the handgrips in the embodiment of FIG. 1.

FIG. 4 is a horizontal sectional view taken along line 4-4 in FIG. 3.

FIGS. 5-7 are views similar to FIG. 4 with spring arms of different diameters installed in the handgrip.

FIG. 8 is an isometric view of another embodiment of a handgrip for use in the embodiment of FIG. 1.

FIG. 9 is a vertical sectional view taken along line 9-9 in FIG. 8.

FIGS. 10 and 11 are enlarged horizontal sectional views taken along lines 10-10 and 11-11 in FIG. 9.

FIG. 23 is an isometric view of another embodiment of a handgrip for use in the embodiment of FIG. 1.

FIGS. 24 and 25 are vertical sectional views taken along lines 24-24 and 25-25 in FIG. 23.

FIG. 26 is an enlarged top plan view of the embodiment of FIG. 23.

FIG. 27 is an enlarged bottom plan view of the embodiment of FIG. 23.

FIG. 28 is an enlarged horizontal sectional view taken along line 28-28 in FIG. 23.

FIG. 33 is an exploded isometric view of another embodiment of a handgrip for use in a grip exerciser according to the invention.

FIG. 34 is a vertical sectional view taken along line 34-34 in FIG. 33.

FIG. 35 is a partially exploded isometric view of another embodiment of a grip exerciser according to the invention.

FIG. 36 is a front elevational view of the embodiment of FIG. 35.

DETAILED DESCRIPTION

Figure 1:
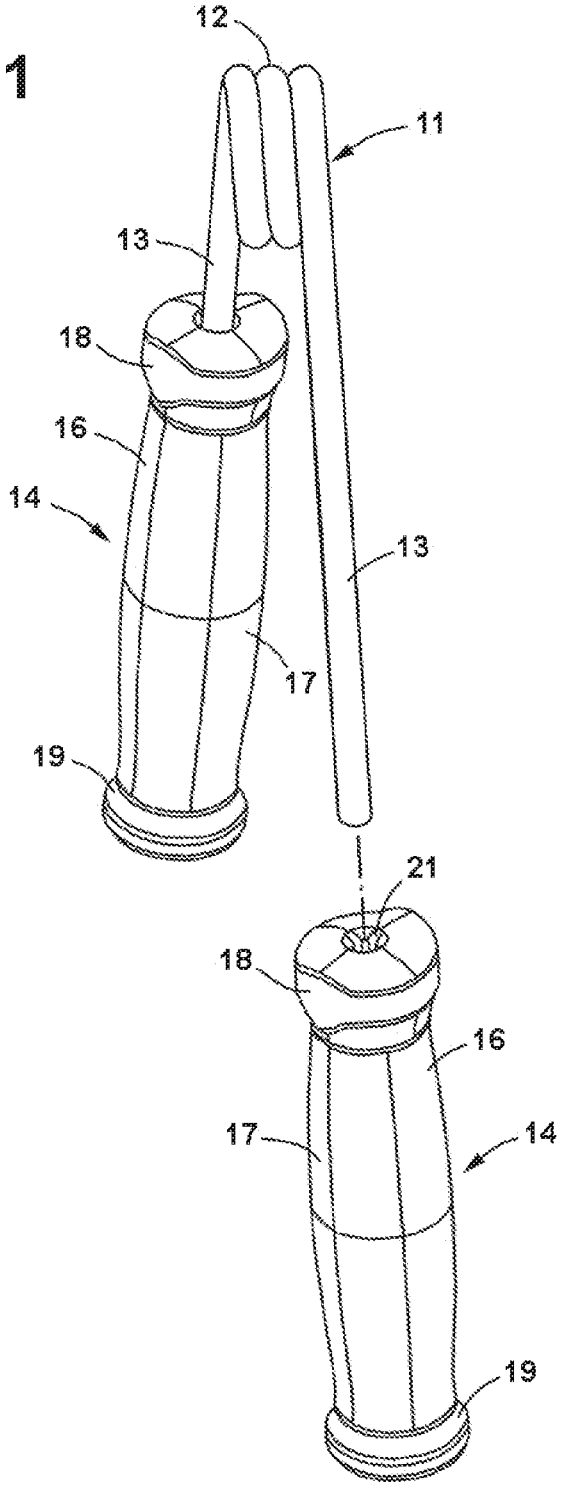
FIG. 1 is a partly exploded isometric view of one embodiment of a grip exerciser according to the invention.
Figure 12:
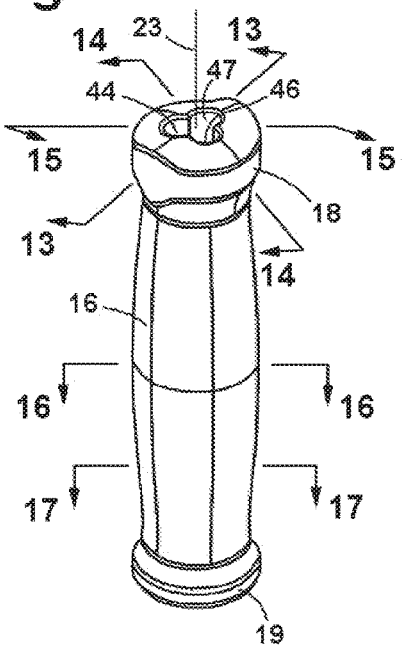
FIG. 12 is an isometric view of another embodiment of a handgrip for use in the embodiment of FIG. 1.
Figure 13:
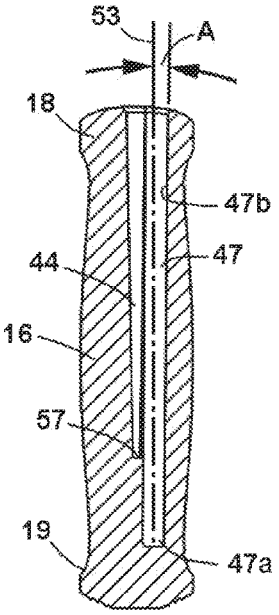
FIGS. 13, 14, and 15 are vertical sectional views taken along lines 13-13, 14-14, and 15-15 in FIG. 12.
Figure 14:
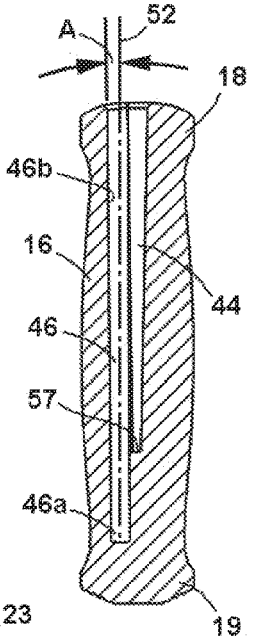
Figure 15:
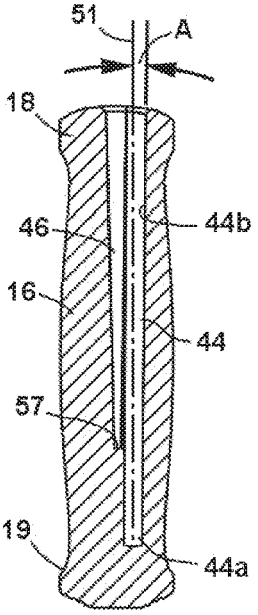
Figure 16:
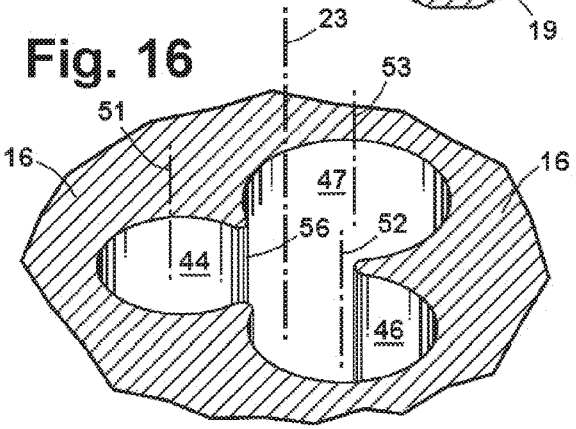
FIGS. 16 and 17 are enlarged isometric sectional views taken along lines 16-16 and 17-17 in FIG. 9.
Figure 17:
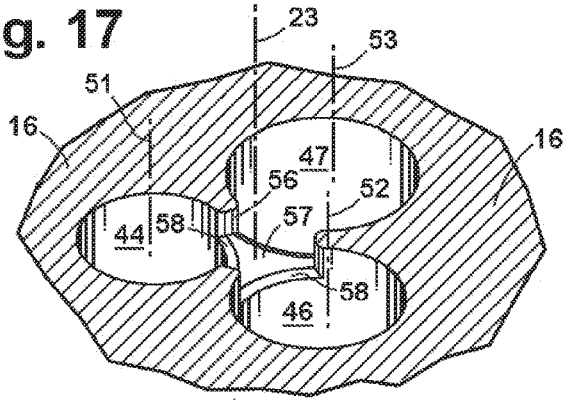
Figure 18:
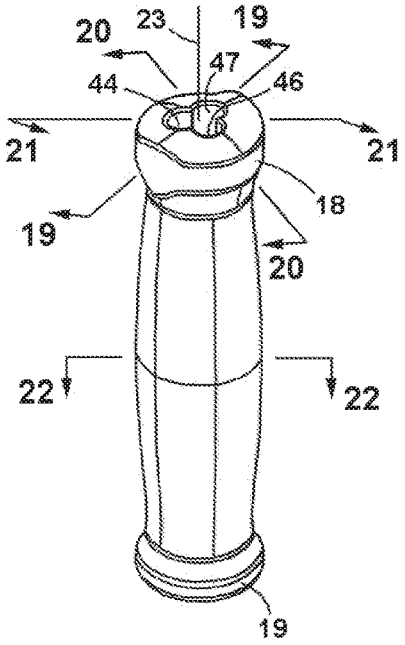
FIG. 18 is an isometric view of another embodiment of a handgrip for use in the embodiment of FIG. 1.
Figure 19:
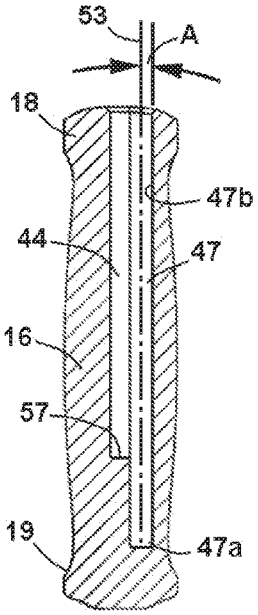
FIGS. 19, 20, and 21 are vertical sectional views taken along lines 19-19, 20-20, and 21-21 in FIG. 18.
Figure 20:
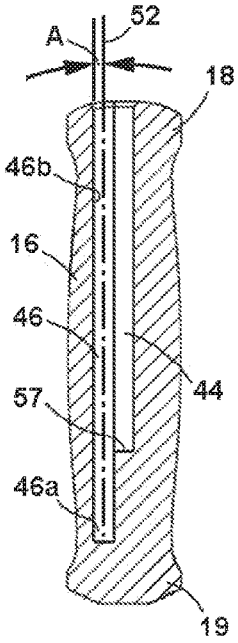
Figure 21:
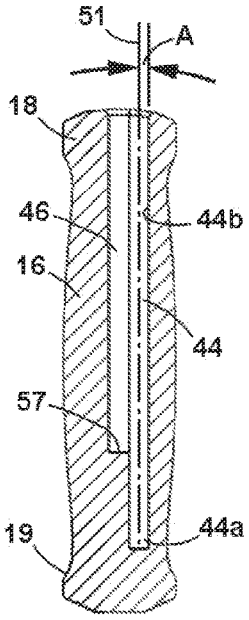
Figure 22:
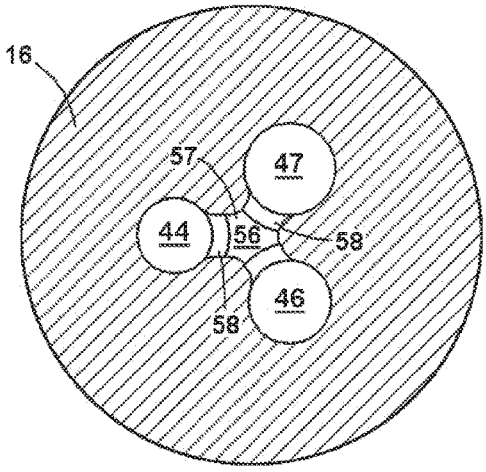
FIG. 22 is an enlarged horizontal sectional view taken along line 22-22 in FIG. 18.
Figure 29:
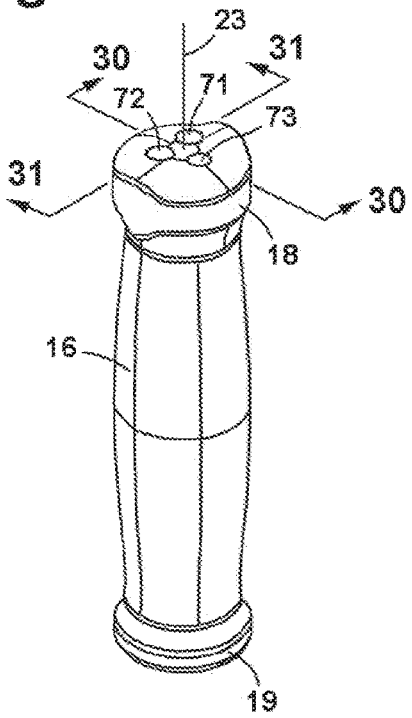
FIG. 29 is an isometric view of another embodiment of a handgrip for use in the embodiment of FIG. 1.
Figure 30:
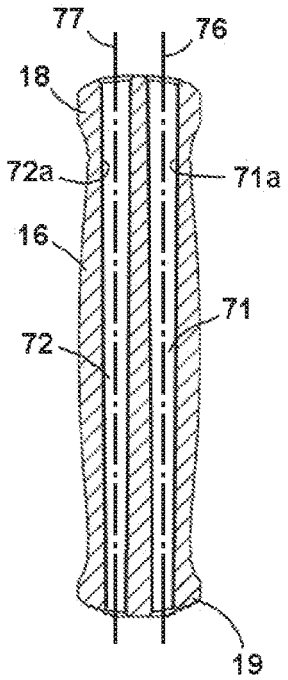
FIGS. 30 and 31 are vertical sectional views taken along lines 24-24 and 25-25 in FIG. 29.
Figure 31:
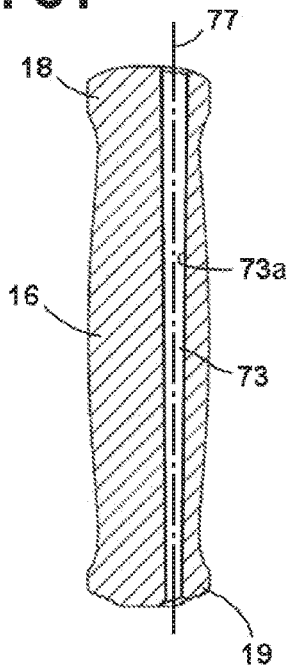
Figure 32:
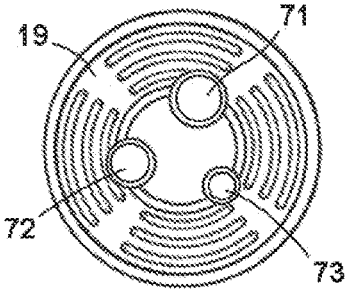
FIG. 32 is an enlarged bottom plan view of the embodiment of FIG. 29.

As illustrated in FIG. 1, the grip exerciser includes a resistance element 11 in the form of a helical torsion spring with a coiled central section 12 and a pair of diverging arms 13 extending from opposite ends of the coil, with handgrips or handles 14 mounted on the spring arms and adapted to be grasped by the hand of a user and squeezed together against the force of the spring. The grips are designed to be used interchangeably with springs of different sizes and resistances.

The resistance of the spring is dependent upon factors such as the springiness of the material from which it is made, the number of convolutions or turns in the coil, and the cross-sectional size or diameter of the wire or rod from which it is made. In the embodiment illustrated, the coil has approximately 2½ convolutions or turns, and the arms diverge at an angle on the order of 30 degrees. However, the coil can have a greater or lesser number of turns, depending on the resistance level desired. The spring is fabricated of steel rod of circular cross section with a diameter corresponding to the spring's resistance.

Each of the handgrips or handles has an elongated body 16 which is generally circular in cross section and contoured lengthwise to facilitate gripping. In the embodiment illustrated, the body has a convexly curved central section 17 with enlarged end sections or knobs 18, 19. The grips are fabricated of a rubberized material such as rubber or rubber-like material, with the external surfaces of the grips acting as a friction interface and control surface between the user and the exerciser assembly. In one presently preferred embodiment, the grips are fabricated of a vulcanized silicone. Other suitable materials include a vulcanized urethane and other thermoplastic rubbers such as styrene butadiene rubber (SBR), styrene butadiene styrene (SBS), nitrile rubber (NBR), and others.

When the handgrips are mounted on a spring, the spring arms are received in longitudinally extending boreholes 21 in the grips, with the rubberized walls of the bores acting as a connecting point for the grips and as the primary friction surface between the grips and the steel rods of the coil spring. The boreholes can vary in size or diameter, shape, depth, and layout or orientation within the grips. The holes can be matched to the steel rod diameters for a zero-tolerance fit or sized to allow a looser or tighter fit. The rubberized side walls of the boreholes act as a natural stop or rotational braking surface against the steel spring arms and as a friction-fit surface to hold the grips tightly to the spring arms, eliminating any travel of the grips along the spring arms while on the arms during use. While the boreholes are designed to allow the spring arms and grips to have a snug, tight surface-to-surface fit when joined together, the flexibility and/or resiliency of the rubberized grip material allows the grips to be slipped on and off the spring arms. The result is that the surface-to-surface fit between the walls of the boreholes and the steel arms of the springs provides sufficient resistance to hold the grips in place on the arms while still allowing rotational slippage/freedom of the rubber grip around the axis of the steel spring arms during use, thus giving the user greater control and comfort while exercising the hand.

In the embodiment of FIG. 1, as further illustrated in FIGS. 2-7, borehole 21 is disposed coaxially of handgrip 12 and is generally star-shaped in cross section, with four axially extending ribs 22 spaced circumferentially in quadrature about the axis 23 of the handgrip and bore for frictional engagement with a spring arm. The ribs are formed integrally with the rest of the grip and have rounded inner faces 22*a* which are spaced apart diametrically by a distance D1. The ribs also have concavely curved side faces 22*b* which extend laterally from the inner faces and come together like the points of a star to form the star-shaped opening with a diameter D2. Being fabricated of a resilient, rubberized material, the ribs are radially compressible and can accommodate spring arms of different diameters.

In one exemplary embodiment, the grips are designed to be used interchangeably with springs having arms 27, 28, 29 that are 5.0 mm, 5.5 mm, and 6.0 mm in diameter. In this example, borehole 21 has an inner diameter D1 of 0.15 inch between the inner faces of the ribs and an outer diameter D2 of 0.36 inch between the outer points of the opening. The degree to which the ribs are compressed by each of the three springs is illustrated in FIGS. 5-7. In each case, the frictional contact between the resilient ribs and the rigid steel rod permits rotational slippage of the handgrip about the spring arm and limits axial movement of the handgrip on the spring arm when the grip exerciser is in use and permits the handgrip to be slid axially along the spring arms during installation and removal of the handgrip.

Markings such as the radial lines 31 and the circle 32 on the upper end of the grip are largely ornamental and not part of the invention.

The rubber-like material employed in the grips should be a material that deforms elastically when the springs are placed into the bores and is resilient enough to provide a sufficient degree of friction to resist slipping and twisting during use. The material should be durable and flexible. Vulcanized elastomer compounds such as vulcanized silicone, vulcanized urethane, crosslinked polyethylene such as ethyl-vinyl acetate (EVA) and EVA-rubber blends, other thermoset rubbers such as epoxies or cured resins with similar characteristics, and blended variants of such compounds seem to have the most durable characteristics and are particularly suitable for use in the invention. One such example would be a compression molded silicone application, which creates a durable handle due to the vulcanizing process.

Thermoplastic elastomers can also be used, and even though they may be somewhat less durable, they still meet the flexibility requirement. Examples of thermoplastic rubbers (TPR) that are suitable for use in the invention include thermoplastic polyurethanes, thermoplastic polyolefin elastomers, thermoplastic styrenes such as styrene butadiene rubber, styrene butadiene styrene (SBS), polyvinylchloride, thermoplastic co-polyesters, and other similar resins blends. Thermoplastic materials have favorable manufacturing attributes and cost considerations such as faster-cycle times for an injection molding process and a significantly higher yield rate, with little to no scrap or waste. One example of a material for use in high volume production is an injection molded SBS material.

The handles or grips can be manufactured by various molding techniques such as injection molding, compression molding, transfer molding, rotational molding, and various casting techniques. Compression molding is particularly preferred since it allows the inner geometry of handle to have zero draft for maximizing friction against the spring leg.

The rubber-like material should be soft and resilient in nature, with a durometer in the range of 10-95 Shore A and, more preferably, 50-75 Shore A, with a durometer of 65 Shore A providing a particularly good balance for vulcanized silicone.

In the embodiment of FIGS. 8-11, each of the grips has a pair of longitudinally extending boreholes 36, 37 of different dimensions for receiving spring arms of different diameters. These bores are spaced apart on opposite sides of the central axis 23 of the handgrip and are aligned diametrically. They open through the upper end of the handgrip and have closed lower ends 36*a*, 37*a* toward the lower end of the handgrip. Bores 36, 37 are tapered and decrease in diameter from the upper end of the handgrip to the closed ends of the bores, with the axes 38, 39 of the bores being parallel to the central axis 23 of the handgrip and a draft angle A between the side walls 36*b*, 37*b* and axes of the bores. The draft angle increases frictional engagement between the side walls of the bores and spring arms, controls and limits rotation, promotes installation and removal, and facilitates manufacture of the grips.

In an exemplary embodiment, borehole 36 is sized to fit a 5.0 mm spring arm and to accommodate a 5.5 mm arm, and borehole 37 is sized to fit a 6.0 mm spring arm and to accommodate a 5.5 mm arm. In this embodiment bore 36 has an upper diameter of 0.23 inch and a lower diameter of 0.16 inch, and bore 37 has an upper diameter of 0.27 inch and a lower diameter of 0.20 inch, with each bore having a draft angle of 0.5 degree.

To reduce and control friction between the walls of the bores and the spring arms in this embodiment, a portion of the material between the bores is cut away by a slotted opening 41 which extends along central axis 23 from the upper end of the handgrip to a point near the lower ends of the bores. This opening intersects the side walls of the bores and thereby reduces the amount of rubberized material in frictional contact with the spring arm and limits the amount of force required to insert or remove the spring. Terminating the slotted opening above the lower ends of the bores leaves a septum or land 42 which separates the lower end portions of the bores below the opening and creates pockets that help to position and hold the lower end of the spring arm, preventing it from slipping into the other borehole. As best seen in FIG. 9, the corners of the septum or land are rounded where they meet the bores to facilitate insertion of the spring arm into the end portions of the bores.

FIGS. 12-17 illustrate an embodiment in which handgrip 14 has three longitudinally extending bores 44, 46, 47 spaced 120 degrees apart about central axis 23 for receiving spring arms of different diameters. As in the previous embodiment, these bores open through the upper end of the grip and have closed lower ends 44*a*, 46*a*, 47*a* near the lower end of the grip. Bores 44, 46, 47 are tapered and decrease in diameter from the upper end of the handgrip to the lower ends of the bores, with the axes 51, 52, 53 of the bores being parallel to the central axis 23 of the handgrip and a draft angle A between the side walls 44*b*, 46*b*, 47*b* and axes of the bores.

In an exemplary embodiment, borehole 44 is sized to fit a 5.0 mm spring arm and has an upper diameter of 0.23 inch, a lower diameter of 0.16 inch, and a draft angle of 0.5 degree. Borehole 46 is sized to fit a 5.5 mm spring arm and has an upper diameter of 0.25 inch, a lower diameter of 0.18 inch, and a draft angle of 0.5 degree. Borehole 47 is sized to fit a 6.0 mm spring arm and has an upper diameter of 0.27 inch, a lower diameter of 0.20 inch, and a draft angle of 0.5 degree.

A portion of the material between the bores is cut away by an opening 56 which extends along central axis 23 from the upper end of the handgrip to a point above the lower ends of the bores. This opening intersects the side walls of the bores and thereby reduces the amount of rubberized material in frictional contact with the spring arm and limits the amount of force required to insert or remove the spring arms. Terminating the central opening above the lower ends of the bores leaves a septum or land 57 which separates the lower end portions of the bores below the opening and creates pockets that help to position and hold the lower end of the spring arm, preventing it from slipping into one of the other boreholes. As in the embodiment of FIGS. 8-11, the corners 58 of the septum or land are rounded or beveled where they meet the bores to facilitate insertion of the spring arm into the lower portions of the bores.

The embodiment shown in FIGS. 18-22 is generally similar to the embodiment of FIGS. 12-17, and like reference numerals designate corresponding elements in the two embodiments. In the embodiment of FIGS. 18-22, however, boreholes 44, 46, 47 are straight, with zero draft angle, and side walls 44*b*, 46*b*, 47*b* are parallel to central axis 23 and to the axes of the bores. The straight, untapered side walls improve the fit of all three spring arms and increase the friction of the grip on the springs. The zero draft holes engage more of the spring arms for improved performance and control, and help to prevent the spring arms from wandering into another hole.

FIGS. 23-28 illustrate an embodiment in which handgrip 14 has four longitudinally extending bores 61, 62, 63, 64 spaced in quadrature about central axis 23 for receiving spring arms of different diameters. These bores are arranged in diametrically opposed pairs which open through opposite ends of the grip and have closed ends 61*a*, 62*a*, 63*a*, 64*a* near the ends of the grip opposite to the ends they open through. In the example illustrated, bores 61, 62 open through the upper end of the grip and have closed ends 61*a*, 62*a* near the lower end of the grip, and bores 63, 64 open through the lower end of the grip and have closed ends 63*a*, 64*a* near the upper end of the grip. The holes are tapered, decreasing in diameter from the open ends to the closed ends, with the axes 66, 67, 68, 69 of the bores parallel to central axis 23 and a draft angle A between the side walls 61*b*, 62*b*, 63*b*, 64*b* and axes of the bores.

In an exemplary embodiment, borehole 61 is sized to fit a 6.0 mm spring arm and has an open end diameter of 0.28 inch, a closed end diameter of 0.20 inch, and a draft angle of 0.5 degree. Borehole 62 is sized to fit a 5.5 mm spring arm and has an open end diameter of 0.26 inch, a closed end diameter of 0.19 inch, and a draft angle of 0.5 degree. Borehole 63 is sized to fit a 5.0 mm spring arm and has an open end diameter of 0.24 inch, a closed end diameter of 0.17 inch, and a draft angle of 0.5 degree. Borehole 64 is sized to fit a 6.5 mm spring arm and has an open end diameter of 0.30 inch, a closed end diameter of 0.22 inch, and a draft angle of 0.5 degree.

In this embodiment, the grip is solid between the bores, there is no central opening, the side walls of the bores are in full 360 degree contact with the spring arms, and the diameters of the bores are slightly larger than in the embodiments with less than 360 degrees of side wall contact.

FIGS. 29-32 illustrate an embodiment in which handgrip 14 has three longitudinally extending bores 71, 72, 73 spaced 120 degrees apart about central axis 23 for receiving spring arms of different diameters. These bores extend the full length of the grip and open through both the upper and lower ends of the grip. The holes are tapered, decreasing in diameter from the open end to the lower end, with the axes 76, 77, 78 of the bores parallel to central axis 23 and a draft angle on the order of 0.5 degree between the side walls 71*a*, 72*a*, 73*a* and axes of the bores.

In an exemplary embodiment, borehole 71 is sized to fit a 6.0 mm spring arm and has an open end diameter of 0.28 inch, a closed end diameter of 0.20 inch, and a draft angle of 0.5 degree. Borehole 72 is sized to fit a 5.5 mm spring arm and has an open end diameter of 0.26 inch, a closed end diameter of 0.19 inch, and a draft angle of 0.5 degree. Borehole 73 is sized to fit a 5.0 mm spring arm and has an open end diameter of 0.24 inch, a closed end diameter of 0.17 inch, and a draft angle of 0.5 degree.

As in the embodiment of FIGS. 23-28, the grip is solid between the bores, the side walls of the bores are in full 360 degree contact with the spring arms, and the diameters of the bores are slightly larger than in the embodiments with less than 360 degrees of side wall contact.

FIGS. 33-34 illustrate a two-piece, hybrid handgrip or handle 81 that can be used in grip exercisers of the type disclosed herein. This grip has a relatively hard, rigid outer jacket or shell 82 and a softer, more resilient inner core or insert 83 disposed coaxially within the outer shell. The shell has an outer contour similar to the bodies of the handgrips in the other embodiments, i.e. a surface that is generally circular in cross section and contoured lengthwise to facilitate gripping, with a convexly curved central section 84 with enlarged end sections or knobs 86, 87.

The core is illustrated as having a hexagonal cross section and as being received in mating relationship in an axially extending bore 89 of matching contour in the outer shell.

The core and bore can have other cross-sectional contours, if desired, although a non-circular contour is preferred for preventing unwanted rotation of the core within the shell. The core is retained axially within the shell by an adhesive, although it can be retained by other suitable means such as a mechanical stop.

Core 83 has one or more axially extending bores for receiving spring arms of different sizes, as in the other embodiments discussed above. It is illustrated as having three longitudinally extending bores 91, 92, 93 spaced 120 degrees apart about the central axis 94 of the core, similar to bores 44, 46, 47 in the embodiments of FIGS. 12-17 and 18-22. These bores can be tapered as in FIGS. 12-17, or they can have straight side walls as in FIGS. 18-22, or they can be of any other number and/or configuration desired. They can also open through the bottom end of the grip as well as the top, as in the embodiment of FIGS. 29-32, in which case core 83 and bore 89 will extend to both ends of the shell.

Shell 82 is generally made of a material that is highly durable and hard in nature, with a durometer greater than 95 Shore A, although softer materials with lower durometers (e.g., 10-95 Shore A) can be use in some applications such as ones where user comfort is desired. Suitable materials include metals such as aluminum and steel, hard plastics, and wood. Suitable hard plastics include nylon, polyoxymethylene (POM) which is known as acetal and/or marketed under the Delrin7 trademark, acrylonitrile-butadiene-styrene (ABS), polypropylene, polyvinylchloride (PVC), and polyethylene (PE, HDPE, LDPE, or LLDPE). The shell can also be made of the rubberized materials discussed above in connection with the other embodiments.

The shell can be manufactured by any suitable technique that is compatible with the material being used. Thus, for example, a metal shell can be made by casting and/or machining, and a hard plastic shell can be made by machining, injection molding, blow molding, compression molding, transfer molding, rotational molding, or by any similar method including, but not limited to, the various casting techniques. One specific example would be an injection molded thermoplastic, such as polypropylene.

This shell can also be manufactured through various additive manufacturing techniques, such as 3d printing, fuse deposition modeling, stereo lithography, selective laser sintering, and other suitable material addition processes.

The flexible insert or core can be made of any of the rubber, rubberized, or rubber-like materials discussed above for use in the other embodiments of the exerciser. It can be made as a separate and distinct part from the shell portion of the handle, then assembled with the insert. The two parts can be held together using mechanical means to capture the insert, or chemical means using a solvent or an adhesive, such as glue.

Alternatively, the insert can be manufactured by co-molding the material for the insert into the shell. An example would be a polypropylene injection molded shell, with an over-molded thermoplasticized rubber (TPR) injected into the shell to create the insert. In the polypropylene-TPR combination, the two materials would self-adhere to each other due to material and process characteristics, requiring no adhesives, solvents, or mechanical means to secure the insert within the shell.

The insert can also be cast or compression molded, depending on the handle or shell material and its resistance to higher temperatures. Thus, for example, a cured or vulcanized rubber, such as cast urethane or compression molded silicone, could be molded into a machined aluminum handle or shell.

Thus far, the invention has been described and illustrated in conjunction with helical torsion springs. However, it should be understood that other types of springs can also be employed, and one such example is shown in FIGS. 35-36. In this embodiment, the spring 96 is a generally U shaped spring having an arcuately curved central section 97 and a pair of diverging arms 98 extending from opposite ends of the central section. The central section has an arc length of slightly less than 180 degrees, and the arms diverge at an angle of approximately 7.5 degrees. The resistance of the spring and the force required to squeeze the two arms together are dependent upon factors such as the springiness of the material from which the spring is made, the lengths of the central section and arms, and the cross-sectional size or diameter of the wire or rod from which it is made.

As in the other embodiments, handgrips or handles are mounted on the spring arms and adapted to be grasped by the hand of a user and squeezed together against the force of the spring. The grips are designed to be used interchangeably with springs of different sizes and resistances. The grips shown in FIGS. 35-36 are similar to the grips 14 employed in the embodiment of FIGS. 12-17, with three tapered bores 44, 46, 47 spaced 120 degrees apart about central axis 23 for receiving spring arms of different diameters. It will be understood, however, that the generally U-shaped springs can be used with other grips, including the ones disclosed herein.

The invention has a number of important features and advantages. It provides a grip exerciser having handgrips or handles mounted on the arms of a spring in a manner permitting springs having different resistances to be used interchangeably with a single pair of grips, thereby eliminating the need for a separate exerciser for each level of resistance desired. With grips of rubber or other rubberized material and the spring arms in direct contact with that material, there is sufficient resistance to hold the grips in place on the spring arms while allowing rotational slippage of the grips around the axes of the spring arms when the device is use, yet the resiliency of the material allows the grips to be slid on and off the spring arms during installation and removal of the grips. With no parts other than the rubberized grips and the springs, the exerciser can be manufactured and sold at relatively low cost.

It is apparent from the foregoing that a new and improved grip exerciser has been provided. While only certain presently preferred embodiments have been described in detail, as will be apparent to those familiar with the art, certain changes and modifications can be made without departing from the scope of the invention as defined by the following claims.

The invention claimed is:

1. A grip exerciser for strengthening the grip of the hand and/or muscles of the forearm, comprising a plurality of springs of different sizes and resistances each having a pair of arms which can be squeezed together against the resistance of the spring, a pair of axially elongated handgrips which are removably mounted on the arms of one of the springs and adapted to be interchangeably mounted on the arms of the other springs, each of the handgrips being fabricated at least in part of a rubberized material with at least one longitudinally extending bore having a resilient side wall configured for frictional engagement with spring arms of different diameters in a manner that permits rotational slippage of the handgrips about the spring arms and limits axial movement of the handgrips on the spring arms when the grip exerciser is in use and permits the handgrips to slide axially along the spring arms during installation and removal of the handgrips.

2. The grip exerciser of claim 1 wherein the springs are torsion springs with helically coiled sections, and the arms extend from opposite ends of the helically coiled sections.

3. The grip exerciser of claim 1 wherein the handgrips are fabricated of rubber.

4. The grip exerciser of claim 1 wherein the bores have open ends at upper ends of the handgrips and closed ends toward lower ends of the handgrips.

5. The grip exerciser of claim 4 wherein the bores are tapered and the open ends are of greater diameter than the closed ends.

6. The grip exerciser of claim 1 wherein the bores have straight side walls and are of constant diameter.

7. The grip exerciser of claim 1 wherein the bores extend the full length of the handgrips and open through both upper and lower ends of the handgrips.

8. The grip exerciser of claim 1 wherein some of the bores open through upper ends of the handgrips, and some of the bores open through lower ends of the handgrips.

9. The grip exerciser of claim 1 wherein each of the handgrips has an axially extending bore of star-shaped cross section with axially elongated, radially compressible ribs spaced circumferentially about the bore for frictional engagement with spring arms of different diameters.

10. The grip exerciser of claim 1 wherein each of the handgrips has a plurality of longitudinally extending bores of different diameters spaced about a central axis for receiving spring arms of different diameters.

11. The grip exerciser of claim 10 wherein the bores open through and upper end of the handgrip and have closed lower ends near a lower end of the handgrip.

12. The grip exerciser of claim 11 wherein the bores are tapered and are of greater diameter at the upper end of the handgrip than at the lower ends of the bores.

13. The grip exerciser of claim 11 including an axially extending central opening in the handgrip that intersects the bores between the upper end of the handgrip and a point near the lower ends of the bores, with a septum or land separating lower end portions of the bores below the central opening.

14. A grip exerciser for strengthening the grip of the hand and/or muscles of the forearm, comprising a plurality of springs of different sizes and resistances each having a pair of arms which can be squeezed together against the resistance of the spring, a pair of axially elongated handgrips which are removably mounted on the arms of one of the springs and adapted to be interchangeably mounted on the arms of the other springs, the handgrips being fabricated at least in part of a rubberized material with each handgrip having a pair of longitudinally extending tapered bores of different sizes for receiving spring arms of different diameters, the bores opening through an upper end of the handgrip and having closed lower ends toward a lower end of the handgrip, and an opening in the handgrip that extends between and intersects the bores from the upper end of the handgrip to a point near the lower ends of the bores, with a septum or land separating lower end portions of the bores below the opening.

15. The grip exerciser of claim 14 wherein the springs are torsion springs with helically coiled sections, and the arms extend from opposite ends of the helically coiled sections.

16. The grip exerciser of claim 14 wherein the handgrips are fabricated of rubber.

17. The grip exerciser of claim 14 wherein each of the bores has a draft angle on the order of 0.5 degree and decreases in diameter from the upper end of the handgrip to the lower end of the bore.

18. The grip exerciser of claim 14 wherein the bores are diametrically aligned on opposite sides of the longitudinal central axis of the handgrip.

19. A grip exerciser for strengthening the grip of the hand and/or muscles of the forearm, comprising a plurality of springs of different sizes and resistances each having a pair of arms which can be squeezed together against the resistance of the spring; a pair of axially elongated handgrips which are removably mounted on the arms of one of the springs and adapted to be interchangeably mounted on the arms of the other springs; the handgrips being fabricated at least in part of a rubberized material with each handgrip having three longitudinally extending bores of different sizes for receiving spring arms of different diameters; the three bores being spaced apart, opening through an upper end of the handgrip, and having closed lower ends toward a lower end of the handgrip; and a central opening that extends between and intersects the bores from the upper end of the handgrip to a point near the lower ends of the bores, with a septum or land separating lower end portions of the bores below the central opening.

20. The grip exerciser of claim 19 wherein the springs are torsion springs with helically coiled sections, and the arms extend from opposite ends of the helically coiled sections.

21. The grip exerciser of claim 19 wherein the bores are spaced 120 degrees apart about the longitudinal central axis of the handgrip.

22. The grip exerciser of claim 19 wherein the handgrips are fabricated of rubber.

23. The grip exerciser of claim 19 wherein the bores are tapered and decrease in diameter from the upper end of the handgrip to the lower ends of the bores.

24. The grip exerciser of claim 19 wherein the bores have straight side walls and constant diameters from the upper end of the handgrip to the lower ends of the bores.

25. A grip exerciser for strengthening the grip of the hand and/or muscles of the forearm, comprising a plurality of springs of different sizes and resistances each having a pair of arms which can be squeezed together against the resistance of the spring; a pair of axially elongated handgrips which are removably mounted on the arms of one of the springs and adapted to be interchangeably mounted on the arms of the other springs, the handgrips being fabricated at least in part of a rubberized material with each handgrip having first and second pairs of longitudinally extending bores of different sizes for receiving spring arms of different diameters spaced in quadrature about the longitudinal central axis of the handgrip with the bores in each pair being diametrically opposed, with the first pair of bores opening through a first end of the handgrip and having closed ends near a second end of the handgrip and the second pair of bores opening through the second end of the handgrip and having closed ends toward the first end.

26. The grip exerciser of claim 25 wherein the springs are torsion springs with helically coiled sections, and the arms extend from opposite ends of the helically coiled sections.

27. The grip exerciser of claim 25 wherein the handgrips are fabricated of rubber.

28. The grip exerciser of claim 25 wherein the bores are tapered and decrease in diameter from the ends of the handgrip to the closed ends of the bores.

* * * * *